US012735161B1

(12) United States Patent
Bruno et al.

(10) Patent No.: US 12,735,161 B1
(45) Date of Patent: Sep. 15, 2026

(54) ACCESSORY PODS FOR MARINE VESSELS

(71) Applicant: Brunswick Corporation, Mettawa, IL (US)

(72) Inventors: Corey L. Bruno, Fond du Lac, WI (US); Daniel J. Guse, West Bend, WI (US)

(73) Assignee: Brunswick Corporation, Mettawa, IL (US)

( * ) Notice: Subject to any disclaimer, the term of this patent is extended or adjusted under 35 U.S.C. 154(b) by 457 days.

(21) Appl. No.: 18/469,348

(22) Filed: Sep. 18, 2023

(51) Int. Cl.
*B63H 20/06* (2006.01)
*B63B 34/20* (2020.01)
*B63H 20/12* (2006.01)

(52) U.S. Cl.
CPC ..... *B63H 20/06* (2013.01); *B63H 20/12* (2013.01); *B63B 34/20* (2020.02)

(58) Field of Classification Search
CPC ..... B63H 20/00; B63H 20/02; B63H 20/06; B63H 20/08; B63H 20/12; B63B 34/00; B63B 34/10; B63B 34/20; B63B 34/26
USPC ..... 440/53, 63
See application file for complete search history.

(56) References Cited

U.S. PATENT DOCUMENTS

| | | | | |
|---|---|---|---|---|
| 5,613,459 | A * | 3/1997 | Remy | B63B 34/10 114/343 |
| 5,947,779 | A * | 9/1999 | Heideman | B63H 5/125 440/58 |
| 6,165,031 | A * | 12/2000 | Lonngren | B63H 5/125 440/51 |
| 7,089,876 | B2 | 8/2006 | Porat | |
| 7,182,033 | B1 | 2/2007 | Phillips et al. | |
| 7,185,599 | B1 * | 3/2007 | Griffiths | B63B 1/12 114/263 |
| 9,701,367 | B2 * | 7/2017 | McDonough | B63H 5/125 |
| 2023/0234688 | A1 | 7/2023 | Jaszewski et al. | |
| 2023/0257091 | A1 | 8/2023 | Ahlswede et al. | |
| 2023/0257095 | A1 | 8/2023 | Waldvogel et al. | |

* cited by examiner

*Primary Examiner* — Daniel V Venne
(74) *Attorney, Agent, or Firm* — Andrus Intellectual Property Law, LLP

(57) ABSTRACT

An accessory pod for securing a marine accessory to a hull of a marine vessel includes a pod body configured to be coupled to the hull of the marine vessel and a mounting member on the pod body, the mounting member being configured to support the marine accessory on the pod body. The pod body is positively buoyant in water to support the marine accessory in the water relative to the marine vessel.

20 Claims, 12 Drawing Sheets

ACCESSORY PODS FOR MARINE VESSELS

FIELD

The present disclosure relates to marine vessels and systems and methods for controlling marine vessels, including accessory pods for marine vessels.

BACKGROUND

The following U.S. Patent Publications are incorporated herein by reference in entirety.

U.S. Pat. Pub. No. 2023/0234688 discloses a marine drive for propelling a marine vessel. The marine drive has a propulsor configured to generate a thrust force in a body of water, an electric motor which powers the propulsor, a battery having a battery port for outputting battery power, a supporting frame which supports the marine drive relative to marine vessel, the supporting frame having a frame interior which retains the batter, and a cowling on the supporting frame. The cowling has a first cowl portion and a second cowl portion which is movable relative to the first cowl portion into a closed position enclosing the supporting frame and the battery in a cowling interior and alternately into an open position providing access to the cowling interior enabling insertion and removal of the battery.

U.S. Pat. Pub. No. 2023/0257095 discloses a marine drive for propelling a marine vessel in a body of water. The marine drive comprises a motor housing defining a motor cavity; a motor disposed in the motor cavity; a propulsor shaft extending from the motor housing, wherein the motor is configured to cause rotation of the propulsor shaft; a propulsor which is rotated by the propulsor shaft to create a thrust force in the body of water; and a vent conduit having a first end connected to the motor cavity and a second end which vents the motor cavity to atmosphere.

U.S. Pat. Pub. No. 2023/0257091 discloses a tiller for controlling a marine drive. The tiller has a base bracket assembly and a tiller arm which is extends outwardly from the base bracket assembly. The base bracket assembly is configured to facilitate yaw adjustment of the tiller arm, in particular into and between a variety of yaw positions relative to the base bracket assembly. The tiller arm has a grip restraining device which is located on the bottom of the middle portion of the tiller arm and is manually accessible from both sides of the tiller arm. The grip restraining device is specially configured to selectively restrain rotation of a hand grip on the outer end of the tiller arm. The tiller arm also has a tilt mechanism which facilitates tilting of the tiller arm relative to the base bracket assembly into and between a variety of tilt positions, including a straight upward tilt position and a straight downward tilt position.

SUMMARY

This Summary is provided to introduce a selection of concepts that are further described herein below in the Detailed Description. This Summary is not intended to identify key or essential features of the claimed subject matter, nor is it intended to be used as an aid in limiting the scope of the claimed subject matter.

In non-limiting examples disclosed herein, an accessory pod is configured for securing a marine accessory to a hull of a marine vessel. The accessory pod may include a pod body configured to be coupled to the hull of the marine vessel and a mounting member on the pod body. The mounting member may be configured to support the marine accessory on the pod body. The pod body may be positively buoyant in water to support the marine accessory in the water relative to the marine vessel.

In some examples, the accessory pod is steerable relative to the marine vessel about a steering axis. The accessory pod may be supported on the marine vessel by a steering tube that defines the steering axis. In some examples, the pod body may include a pod hull defining an interior compartment within the pod body. The pod hull may have a hydrodynamic profile configured to reduce a drag force on the accessory pod as the marine vessel travels through the water.

In some examples, the pod body may include a support platform on which the mounting member is located and at least one pontoon configured to support the support platform proximate a surface of the water. The support platform may include an opening through a body of the support platform, and wherein the marine accessory is configured to extend through the opening and into the water. In some examples, the marine accessory may include a marine drive configured to propel the marine vessel through the water. The mounting member may be configured to be engaged by a drive mounting bracket to couple the marine drive to the accessory pod.

In non-limiting examples disclosed herein, an accessory pod assembly is configured to support a marine accessory on a hull of a marine vessel. The accessory pod assembly may include an accessory pod comprising a pod body and a mounting member configured to support the marine accessory on the pod body, and a pod mounting bracket configured to support the accessory pod on the hull of the marine vessel. The pod body may be positively buoyant in water to support the marine accessory in the water relative to the marine vessel.

In some examples, the accessory pod is steerable relative to the pod mounting bracket about a steering axis. A first one of the accessory pod and the pod mounting bracket may include a swivel cylinder and a second one of the accessory pod and the pod mounting bracket may include a steering tube pivotably received in the swivel cylinder, wherein the swivel cylinder and the steering tube define the steering axis. The steering tube may be configured to slide relative to the swivel cylinder along the steering axis to adjust a position of the accessory pod relative to the hull of the marine vessel.

In some examples, the pod mounting bracket may include a pivot bracket defining the steering axis and a mounting arm extending from the pivot bracket to the hull of the marine vessel, wherein the pivot bracket is suspended from the hull of the marine vessel by the mounting arm. The mounting arm may be a first mounting arm pivotable relative to the pivot bracket, and the pod mounting bracket may further include a second mounting arm pivotable relative to the pivot bracket, wherein the pivot bracket is suspended from the hull of the marine vessel by the first mounting arm and the second mounting arm. The first mounting arm and the second mounting arm may be configured to clamp onto the hull of the marine vessel.

In some examples, the pod mounting bracket may include at least one suction cup configured to secure the pod mounting bracket to an exterior surface of the hull of the marine vessel. In some examples, the marine accessory may be a marine drive configured to propel the marine vessel through a body of water. The marine drive may be supported on the accessory pod by a drive mounting bracket that suspends the marine drive from a mounting member of the accessory pod.

In non-limiting examples disclosed herein a marine drive system is configured to be suspended from a hull of a marine vessel. The marine drive system may include an accessory pod comprising a pod body and a mounting member, a pod mounting bracket configured to support the accessory pod on the hull of the marine vessel, and a marine drive configured to propel the marine vessel through a body of water, the marine drive being supported on the accessory pod by the mounting member. The pod body may be positively buoyant in water to support the marine drive in the water relative to the marine vessel and the accessory pod is pivotable relative to the pod mounting bracket about a steering axis to steer the marine drive relative to the marine vessel.

In some examples, the pod mounting bracket may include a pivot bracket defining the steering axis and supporting the accessory pod on the marine vessel, and a first mounting arm and a second mounting arm extending from the pivot bracket to the hull of the marine vessel. The pivot bracket may be suspended from the hull of the marine vessel by the first mounting arm and the second mounting arm. The marine drive system may include a first suction cup on the first mounting arm and a second suction cup on the second mounting arm, wherein the first suction cup and the second suction cup suspend the pivot bracket from the hull of the marine vessel.

Various other features, objects, and advantages will be made apparent from the following description taken together with the drawings.

BRIEF DESCRIPTION OF THE DRAWINGS

The present disclosure is described with reference to the following drawings.

DETAILED DESCRIPTION

In the present description, certain terms have been used for brevity, clarity and understanding. No unnecessary limitations are to be inferred therefrom beyond the requirement of the prior art because such terms are used for descriptive purposes only and are intended to be broadly construed.

Figure 1:
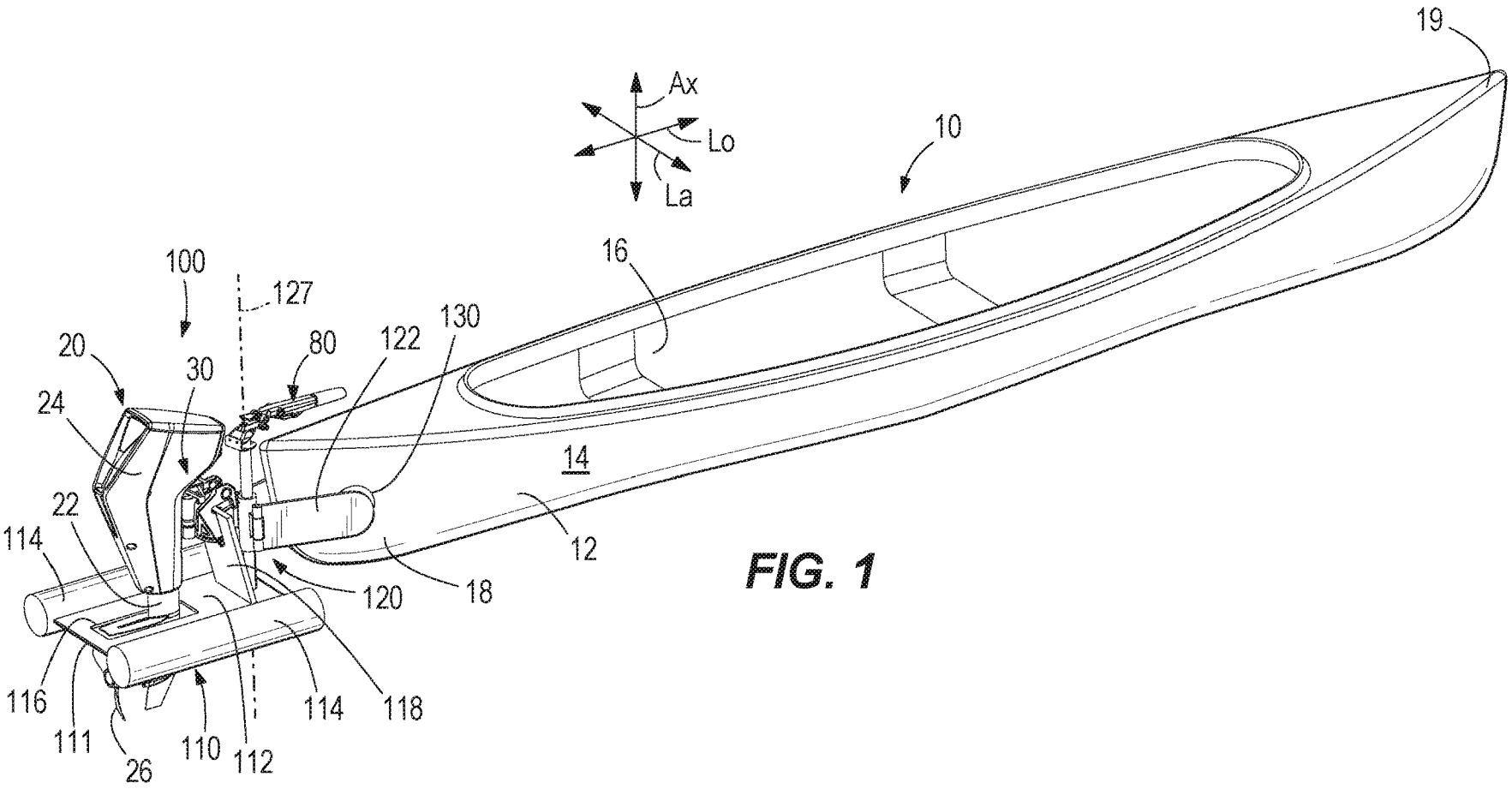
FIG. 1 is a perspective view of a marine vessel with an embodiment of an accessory pod mounted on the rear of the marine vessel.
Figure 2:
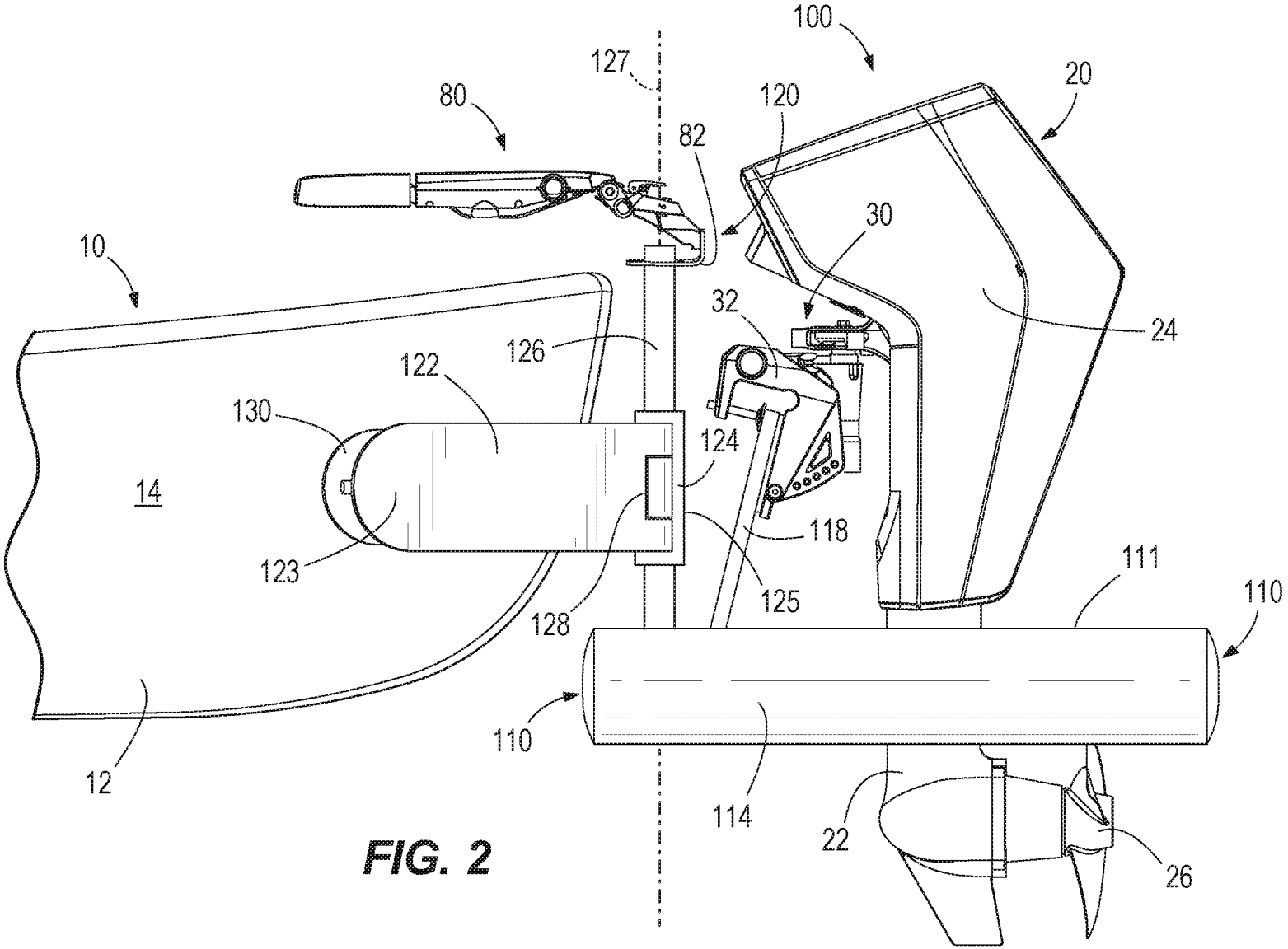
FIG. 2 is a side view of the marine vessel and the accessory pod of FIG. 1.
Figure 3:
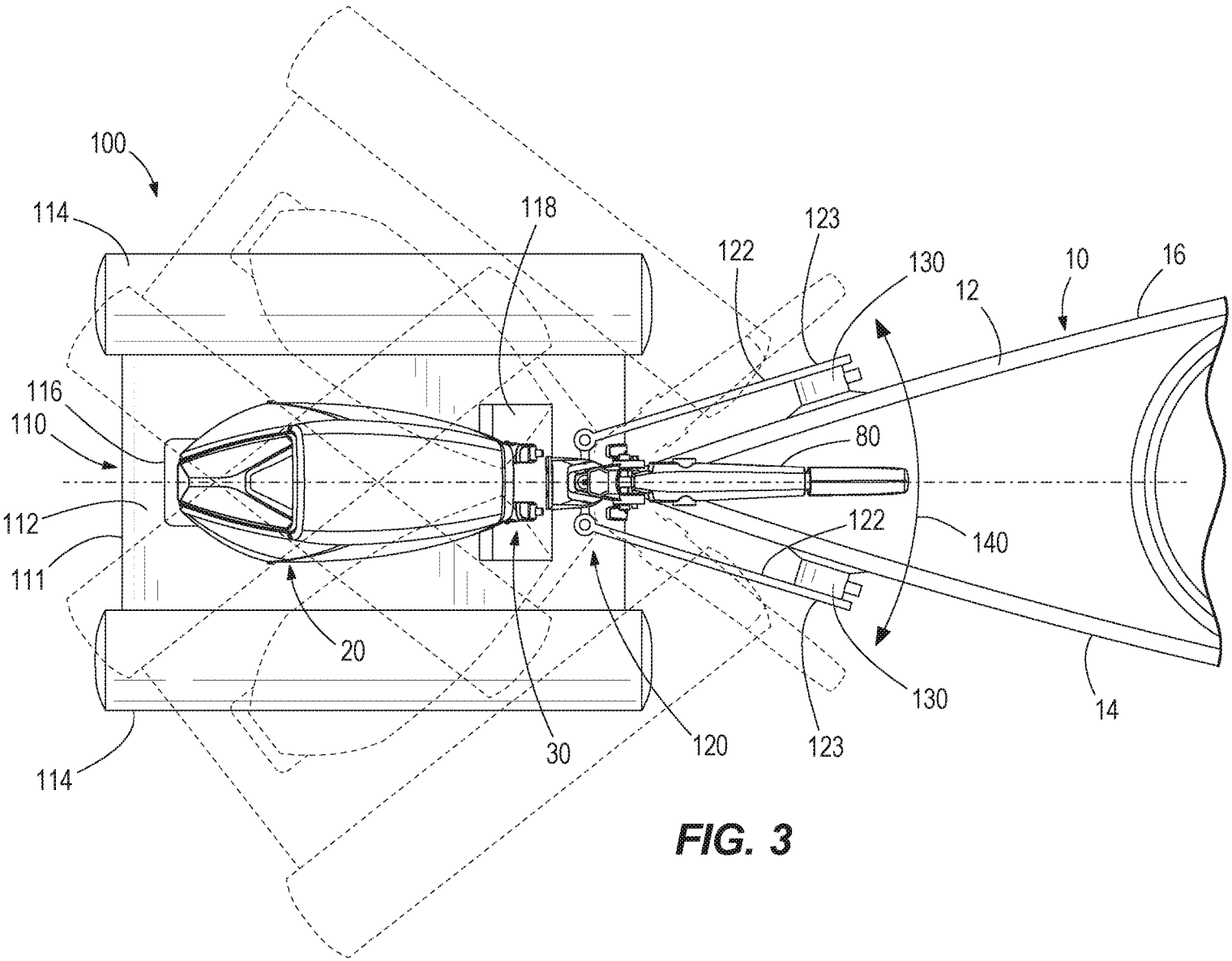
FIG. 3 is a top view of the marine vessel and the accessory pod of FIG. 2.

FIGS. 1-3 illustrate a marine vessel 10 equipped with an embodiment of an accessory pod system 100 configured to support a marine accessory. In the illustrated embodiments, the marine vessel 10 includes a hull 12 that extends from top to bottom in an axial direction AX, from bow 19 to stern 18 in a longitudinal direction LO which is perpendicular to the axial direction AX, and from a port side 14 to an opposite starboard side 16 in a lateral direction LA which is perpendicular to the axial direction AX and perpendicular to the longitudinal direction LO. The illustrated accessory pod system 100 is configured as a marine drive accessory pod system and includes an accessory pod 110, a pod mounting bracket 120 configured to support the accessory pod 110 on the marine vessel 10, and a marine drive 20 that is mounted on the accessory pod 110. In non-limiting embodiments, the marine drive 20 is configured according to one of the embodiments disclosed in U.S. Pat. Pub. Nos. 2023/0234688 and/or 2023/0257095, which are incorporated herein by reference. These publications teach an electric marine drive which is portable and relatively lightweight such that the drive may be manually transported.

As discussed in further detail below, the accessory pod system 100 is steerable relative to the marine vessel 10 about a steering axis 127 so that the accessory pod system 100 is operable to propel the marine vessel 10 through a body of water in a steerable manner. Some embodiments of an accessory pod system, however, may be differently configured. For example, an accessory pod system may omit the noted marine drive and include a different type of marine accessory and/or other equipment. Additionally or alternatively, while the illustrated marine vessel 10 is configured as a canoe, it should be appreciated that embodiments of an accessory pod system may be used with different types of motorized and/or manually powered marine vessels.

Figure 4:
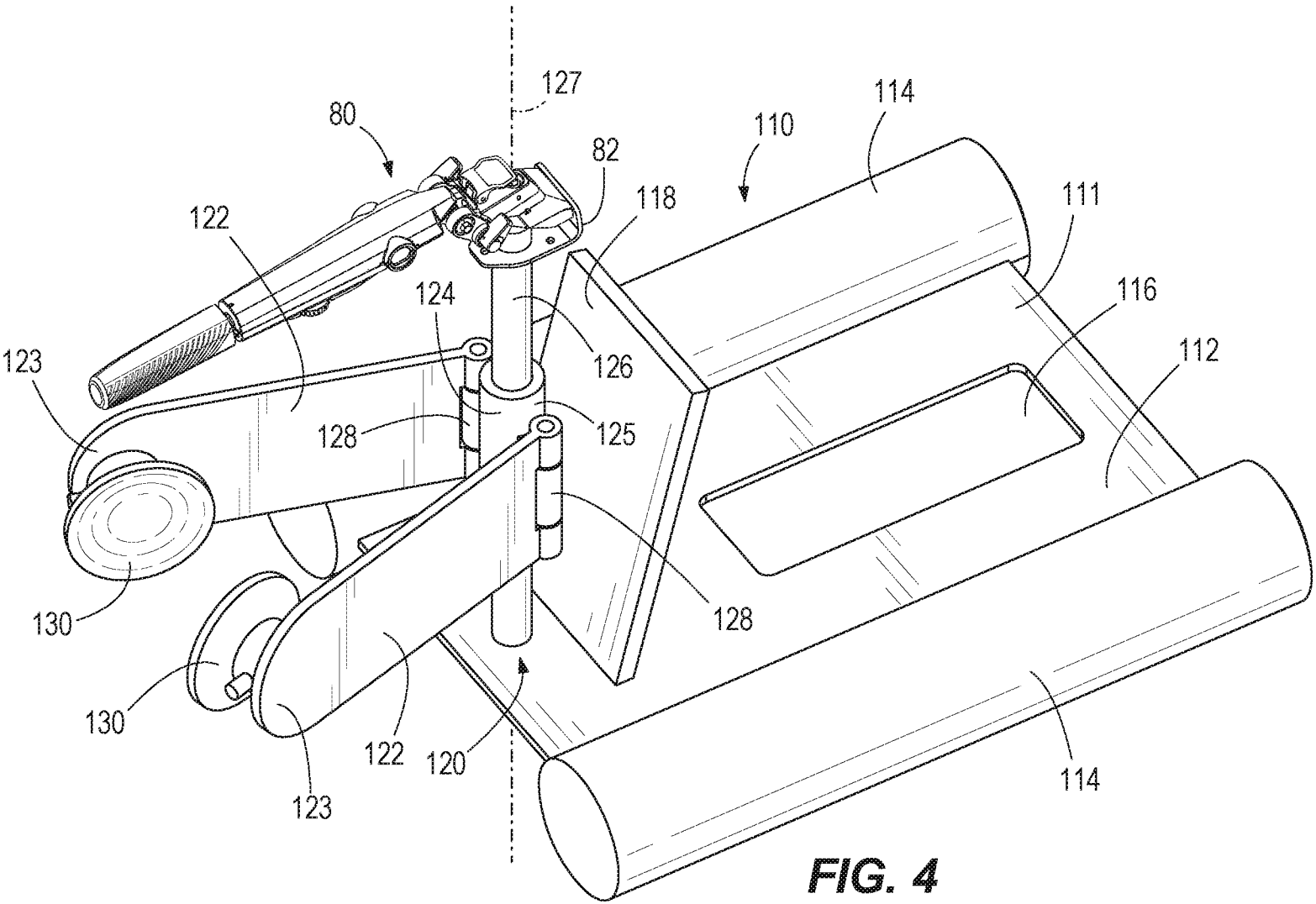
FIG. 4 is a perspective view of the accessory pod of FIG. 3.
Figure 5:
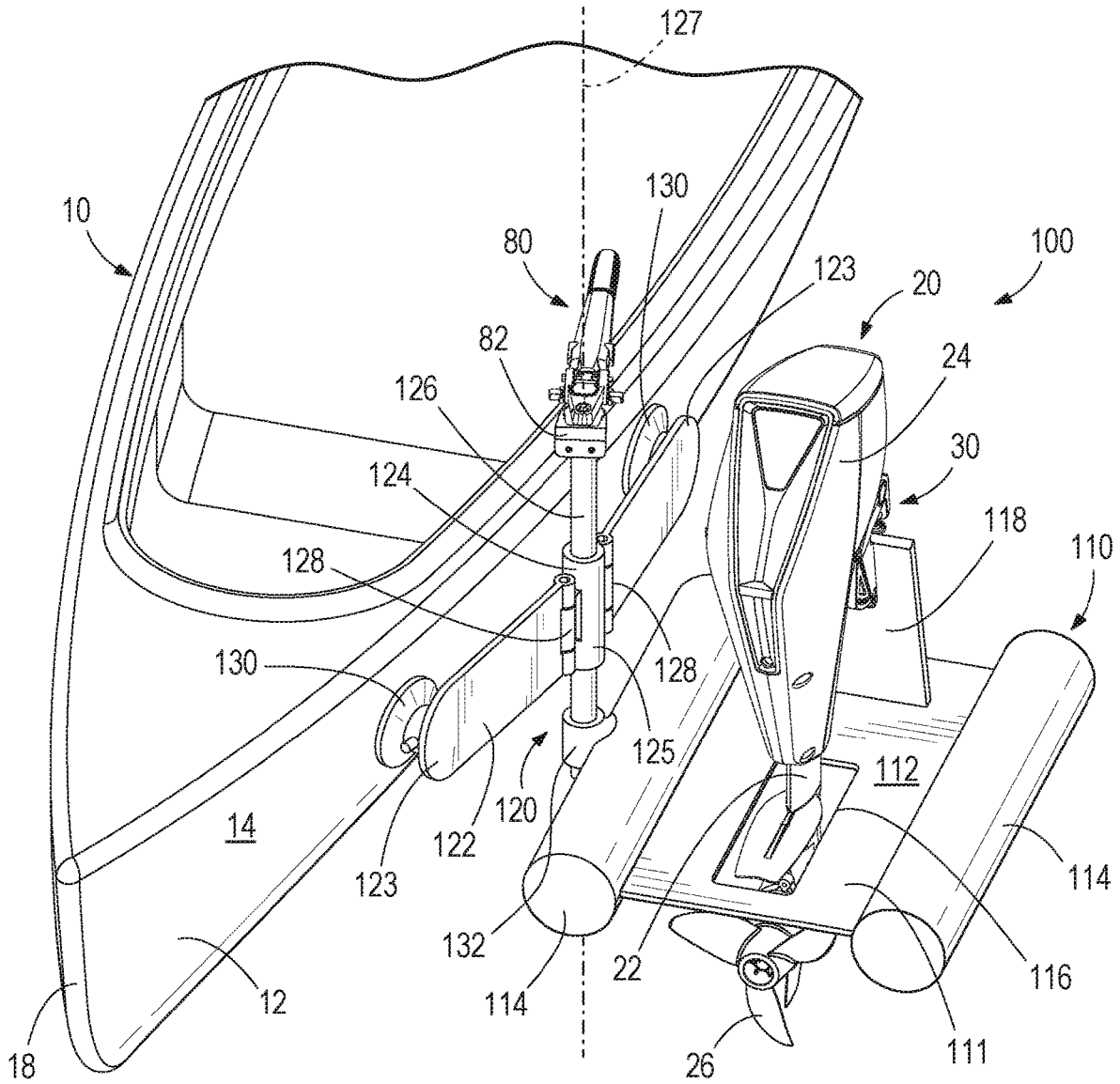
FIG. 5. is a perspective view of the accessory pod of FIG. 4 mounted on the side of the marine vessel.
Figure 6:
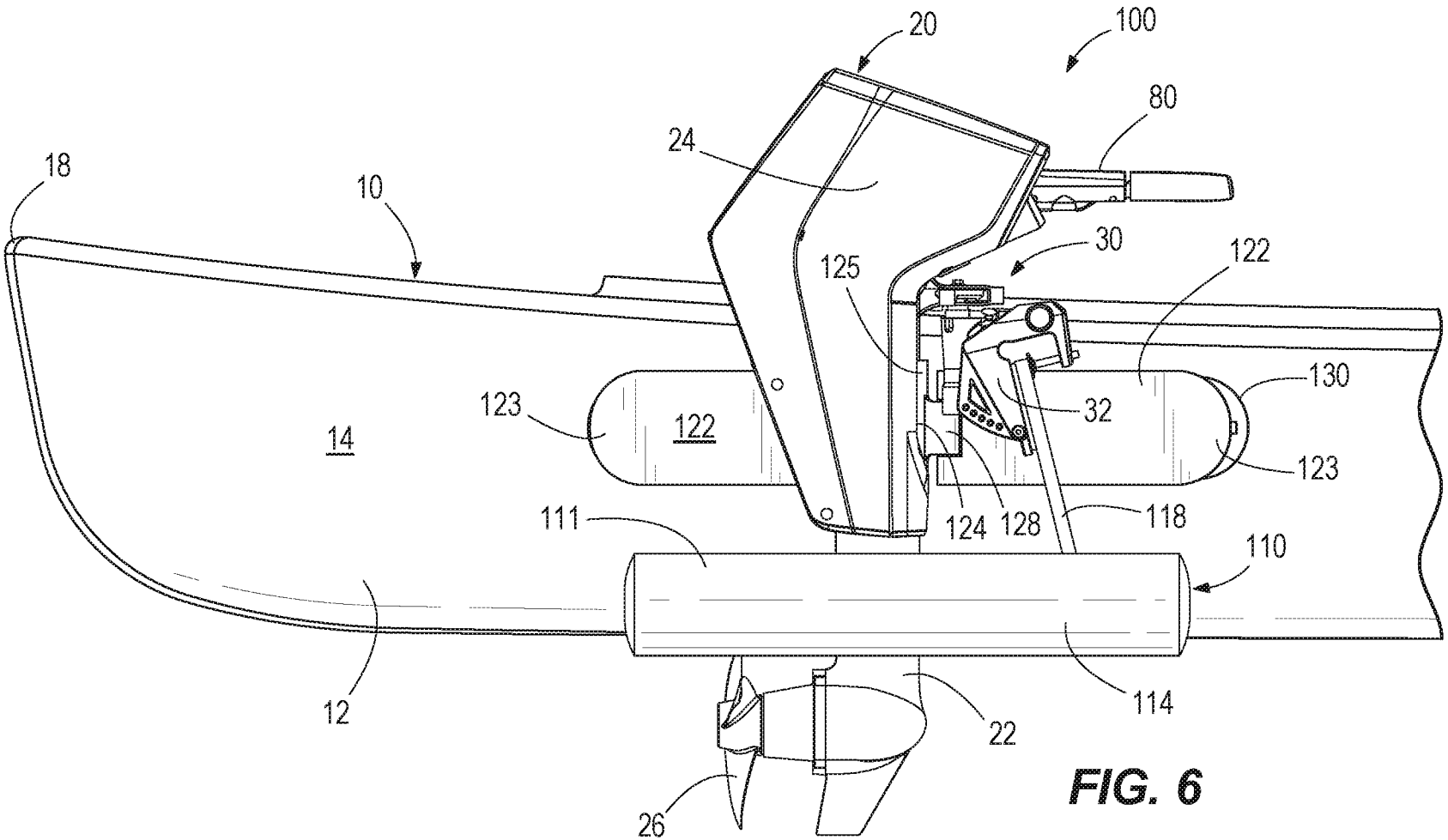
FIG. 6 is a side view of the marine vessel and accessory pod of FIG. 5.

Referring to FIG. 4, the accessory pod 110 includes a pod body 111 with a support platform 112 and at least one pontoon 114 configured to provide a buoyancy force to support (i.e., float) the accessory pod system 100 proximate the surface of the water. In the illustrated embodiments, the support platform 112 is generally planar and rectangular, and one pontoon 114 is positioned on each of the opposing lateral sides of the support platform 112. A mounting member 118 is located on a top side of the support platform 112 and projects upwardly therefrom. The mounting member 118 is a generally planar panel and is configured to support the marine accessory (e.g., the marine drive 20) on the pod body 111.

Referring to FIGS. 2 and 4, the marine drive 20 is suspended from the mounting member 118 by a drive mounting bracket 30. In particular, the illustrated drive mounting bracket 30 is coupled to an upper unit 24 of the marine drive 20 and includes at least one C-clamp 32 that engages and clamps onto the mounting member 118. Advantageously, the illustrated mounting member 118 is configured for use with a standard mounting bracket 30 for a marine drive 20 (e.g., a transom mounting bracket) so that the accessory pod 110 may be used with existing marine drives. A lower unit 22 of the marine drive 20 extends downwards from the upper unit 24, through an opening 116 formed through the support platform 112, and into the water such that the propulsor 26 of the marine drive 20 is submerged. The opening 116 through the support platform is positioned relative to the mounting member 118 so that the center of gravity of the marine drive 20 (or another marine accessory) is positioned above the center of gravity of the accessory pod 110. This may be useful, for example, so that the accessory pod 110 is stable and resistant to overturning when a marine accessory is mounted on the mounting member 118.

Referring to FIGS. 2 and 4, the pod mounting bracket 120 is configured to couple the accessory pod 110 to the hull 12 of the marine vessel 10 and includes a pivot bracket 124 that defines the steering axis 127 and mounting arms 122 which extend from the pivot bracket 124 to suspend the pivot bracket 124 from the hull 12 of the marine vessel 10. The pivot bracket 124 includes a swivel cylinder 125 and a steering tube 126 that is pivotably received in the swivel cylinder 125 such that the swivel cylinder 125 and the steering tube 126 define the steering axis 127. The steering tube 126 projects upwardly from the support platform 112 of the accessory pod 110 and is rigidly connected thereto. Thus, the accessory pod 110 and the steering tube 126 can pivot about the steering axis 127 relative to the pod mounting bracket 120 and the marine vessel 10. Mounting bosses 128 are positioned on opposite sides of the swivel cylinder 125, and each of the mounting arms 122 is pivotably coupled to a corresponding one of the mounting bosses 128. Each mounting arm 122 extends from the corresponding mounting boss 128 to a distal end 123 which includes mounting hardware for coupling the mounting arm 122 to the hull 12 of the marine vessel 10. In the illustrated embodiments, the accessory pod system 100 includes suction cups 130 configured for use as mounting hardware to couple the mounting arm 122 to the hull 12. Some embodiments, however, may be configured with a different type of mounting hardware and/or mounting feature for securing the pod mounting bracket 120 to the marine vessel 10.

With continued reference to FIGS. 2 and 4, the steering tube 126 is slidably received in the swivel cylinder 125 such that the steering tube 126 can slide axially along the steering axis 127 (i.e., up and down) within the swivel cylinder 125. Thus, when the accessory pod system 100 is mounted on a marine vessel 10, the accessory pod 110 and the marine drive 20 (or another marine accessory) mounted thereon may move up and down relative to the hull 12 of the marine vessel 10. This may be useful, for example, so that the accessory pod 110 can maintain its position on the surface of the water while accommodating vertical heaving movement of the marine vessel 10 in the water. In the illustrated embodiment, the axial movement of the steering tube 126 within the swivel cylinder 125 is bound by the support platform 112 at the lower end of the steering tube 126 and a tiller mounting bracket 82, which is positioned at the top end of the steering tube 126 and rigidly couples a tiller arm 80 to the steering tube 126, as shown via dashed lines in FIG. 3. In non-limiting embodiments, the tiller arm 80 is configured according to one of the embodiments set forth in U.S. Pat. Pub. No. 2023/0257091, which is incorporated herein by reference. The tiller arm 80 is positionable in various orientations to facilitate transporting of the marine drive, as disclosed in the noted publications. Some embodiments, however, may include at least one stop member configured to limit the axial movement range of the steering tube 126 within the swivel cylinder 125.

In the illustrated embodiments, the pivot bracket 124 is configured with a steering tube 126 that is rigidly coupled to the accessory pod 110 and a swivel cylinder 125 that is configured to be fixed relative to the marine vessel 10. Some embodiments, however, may be differently configured. For example, an accessory pod system may be configured with a swivel cylinder that is rigidly coupled to the accessory pod and a steering tube that is connected to the mounting arms such that the swivel cylinder can slide axially along the steering tube.

Referring to FIGS. 1-3, the accessory pod system 100 can be coupled to the marine vessel 10 via the articulating mounting arms 122 of the pod mounting bracket 120 so that the accessory pod system 100 can be used to propel the marine vessel 10 through the water. To connect the pod mounting bracket 120 to the hull 12, the accessory pod 110 is moved into a desired position relative to the marine vessel 10 and the mounting arms 122 are moved to engage the suction cups 130 with the marine vessel 10. For example, as illustrated in FIGS. 1-3, the accessory pod 110 is positioned at the stern 18 of the marine vessel 10 and each mounting arm 122 extends out from the swivel cylinder 125 along either the port side 16 or the starboard side 14 of the hull 12. The mounting arms 122 are pressed inwards towards the hull 12 so that the suction cup 130 on each mounting arm 122 engages and is adhered to the corresponding side 14, 16 of the hull 12. Thus, the mounting arms 122 extend around the sides of the hull 12 to clamp the pod mounting bracket 120 onto the hull 12, thereby coupling the accessory pod system 100 to an exterior surface of the marine vessel 10. Advantageously, a user may install the marine drive 20 (or another accessory) on the mounting member 118 before or after the accessory pod 110 is coupled to the marine vessel 10. The pontoons 114 provide sufficient buoyancy force so that the accessory pod 110 is positively buoyant in the water with or without the marine drive 20 (or another accessory) installed on the mounting member 118. Thus, an accessory pod 110 with a marine drive 20 mounted thereon will float on the surface of the water without additional support from the marine vessel 10. This may be useful, for example, so that the marine vessel 10 does not need to be modified to support the additional weight of the accessory pod system 100.

Once the accessory pod system 100 is installed on the marine vessel 10, a user may operate the marine drive 20 to propel the marine vessel 10 through the water, for example utilizing the tiller arm 80. Using the tiller arm 80, a user may pivot the accessory pod 110 towards the port side 16 or the starboard side 14 of the hull 12, for example in a direction of arrow 140 in FIG. 3, to steer the marine vessel in the corresponding starboard or port direction.

In the embodiments of FIGS. 1-3, the accessory pod 110 is secured to the stern 18 portion of the marine vessel 10 by clamping the mounting arms 122 onto the port and starboard sides 16, 14 of the hull 12. However, the mounting arms 122 are configured so that the accessory pod system 100 may be secured to the marine vessel 10 in a variety of different locations. For example, FIGS. 5-8 illustrated an embodiment of the accessory pod system 100 in a configuration which allows the pod mounting bracket 120 to be coupled to the starboard side 14 of the marine vessel 10. As with the embodiments of FIGS. 1-4, the accessory pod system 100 includes an accessory pod 110, a marine drive 20 mounted on a mounting member 118 of the accessory pod 110, and a pod mounting bracket 120 configured to support the accessory pod 110 on the marine vessel 10.

Figure 7:
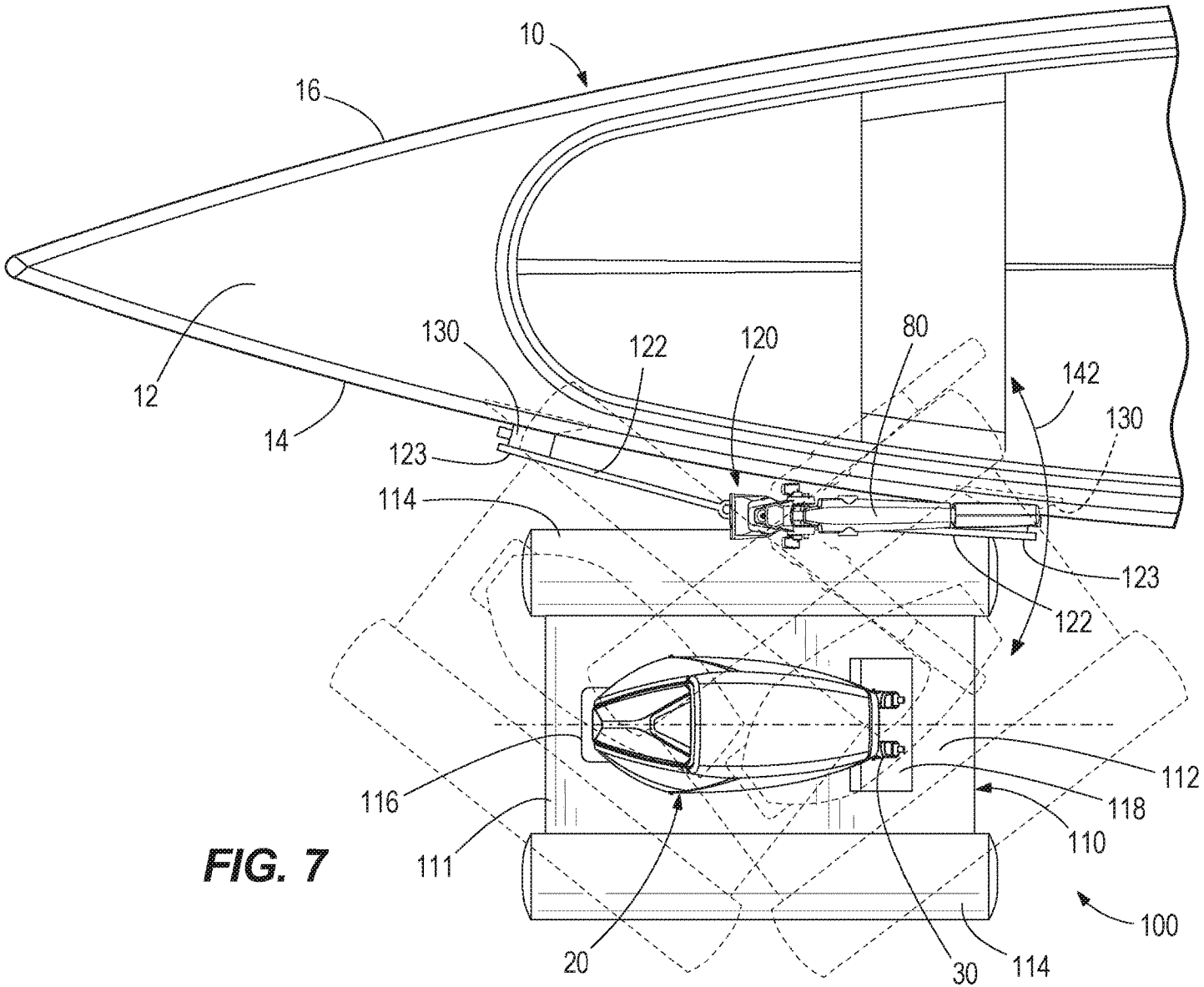
FIG. 7 is a top view of the marine vessel and the accessory pod of FIG. 6.
Figure 8:
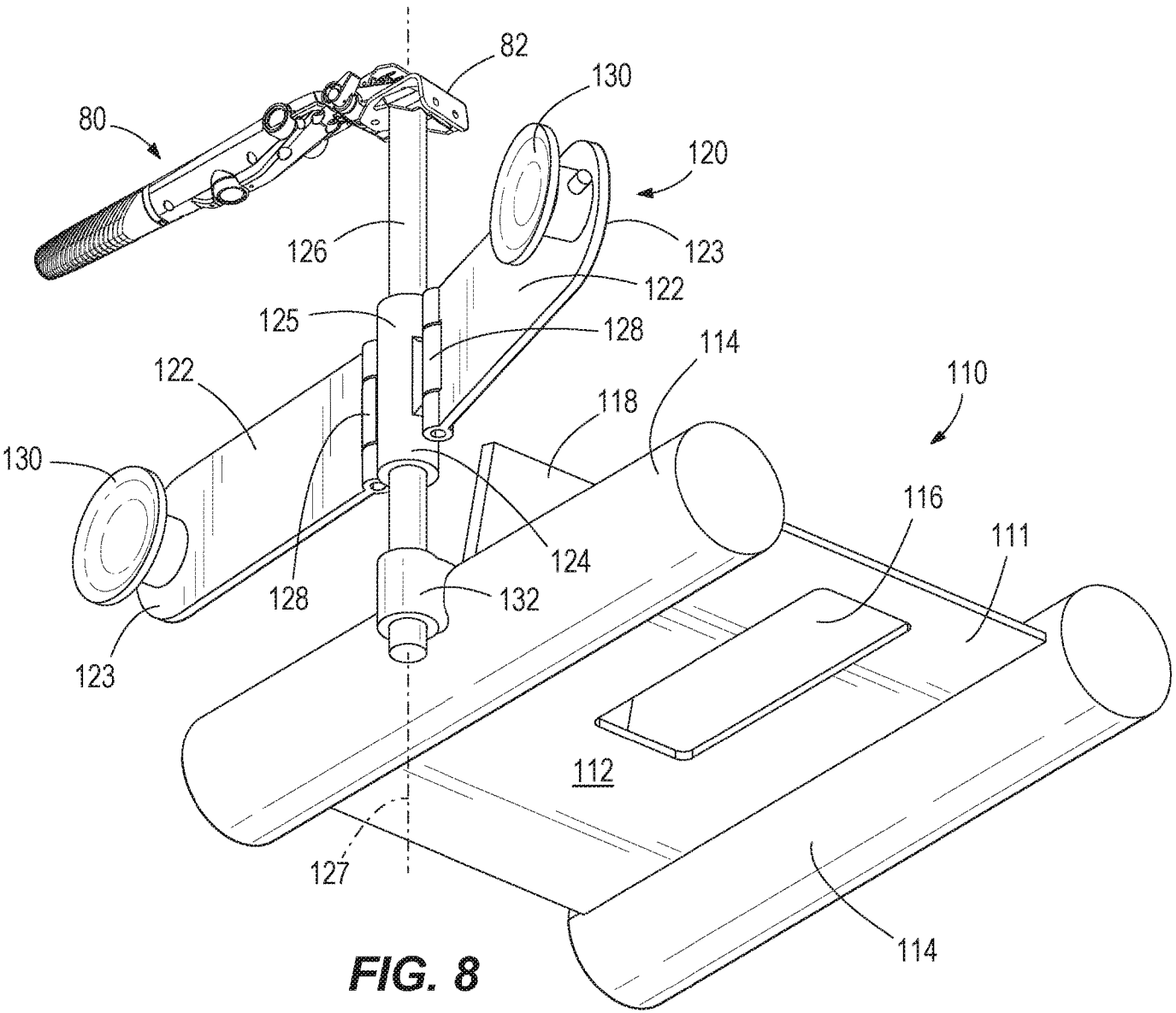
FIG. 8 is a perspective view of the accessory pod of FIG. 7.

In the embodiments of FIGS. 5-8, the accessory pod 110 includes a pontoon mounting boss 132 that is positioned on a lateral side of a pontoon 114. The pontoon mounting boss 132 receives the lower end of the steering tube 126, thereby coupling the pod mounting bracket 120 to the accessory pod 110 via the pontoon 114. This may be useful, for example, so that the accessory pod 110 can be positioned alongside the hull 12 while maintaining a forward-facing orientation. The pod mounting bracket 120 is coupled to the exterior of the hull 12 by the mounting arms 122, which are pivoted about the corresponding mounting boss 128 to extend along the starboard side 14 of the hull 12. Because the mounting arms 122 are pivotable relative to the swivel cylinder 125 and each other, the mounting arms 122 may be moved to conform to a variety of different hull shapes and sizes. This may be useful, for example, so that a user may position the accessory pod system 100 on the marine vessel so that the controls (e.g., the tiller arm 80) are within reach of the operator's position in the marine vessel 10. As illustrated in FIG. 7, the accessory pod 110 can be steered relative to the marine vessel 10 by pivoting the accessory pod 110 in the port or starboard direction indicated by arrow 142. While the accessory pod system 100 is coupled to the starboard side 14 of the hull in FIGS. 1-7, it should be appreciated that the illustrated accessory pod system 100 may alternatively be mounted on the port side 16 of the hull 12.

In the embodiments of FIGS. 1-8, the accessory pod system 100 includes an accessory pod 110 configured as a pontoon-style pod that supports a marine drive 20 proximate the center of the accessory pod 110. Some embodiments, however, may be differently configured. For example, FIGS. 9-12 illustrate an embodiment of an accessory pod system 200 configured to support a marine accessory on the exterior of the hull 12 of a marine vessel 10. Similar to the embodiments of FIGS. 1-8, the marine vessel 10 and the accessory pod system 200 generally extend from top to bottom in an axial direction AX, from front to back in a longitudinal direction LO which is perpendicular to the axial direction AX, and between opposing lateral sides in a lateral direction LA which is perpendicular to the axial direction AX and perpendicular to the longitudinal direction LO. The accessory pod system 200 includes an accessory pod 210, a marine drive 20 supported on the accessory pod 210, and a pod mounting bracket 220 that supports the accessory pod 210 on the exterior of the hull. Unlike the accessory pod 110 of FIGS. 1-8, however, the accessory pod 210 of FIGS. 9-12 is configured with a hydrodynamic hull 214 and an interior compartment 216.

Figure 12:
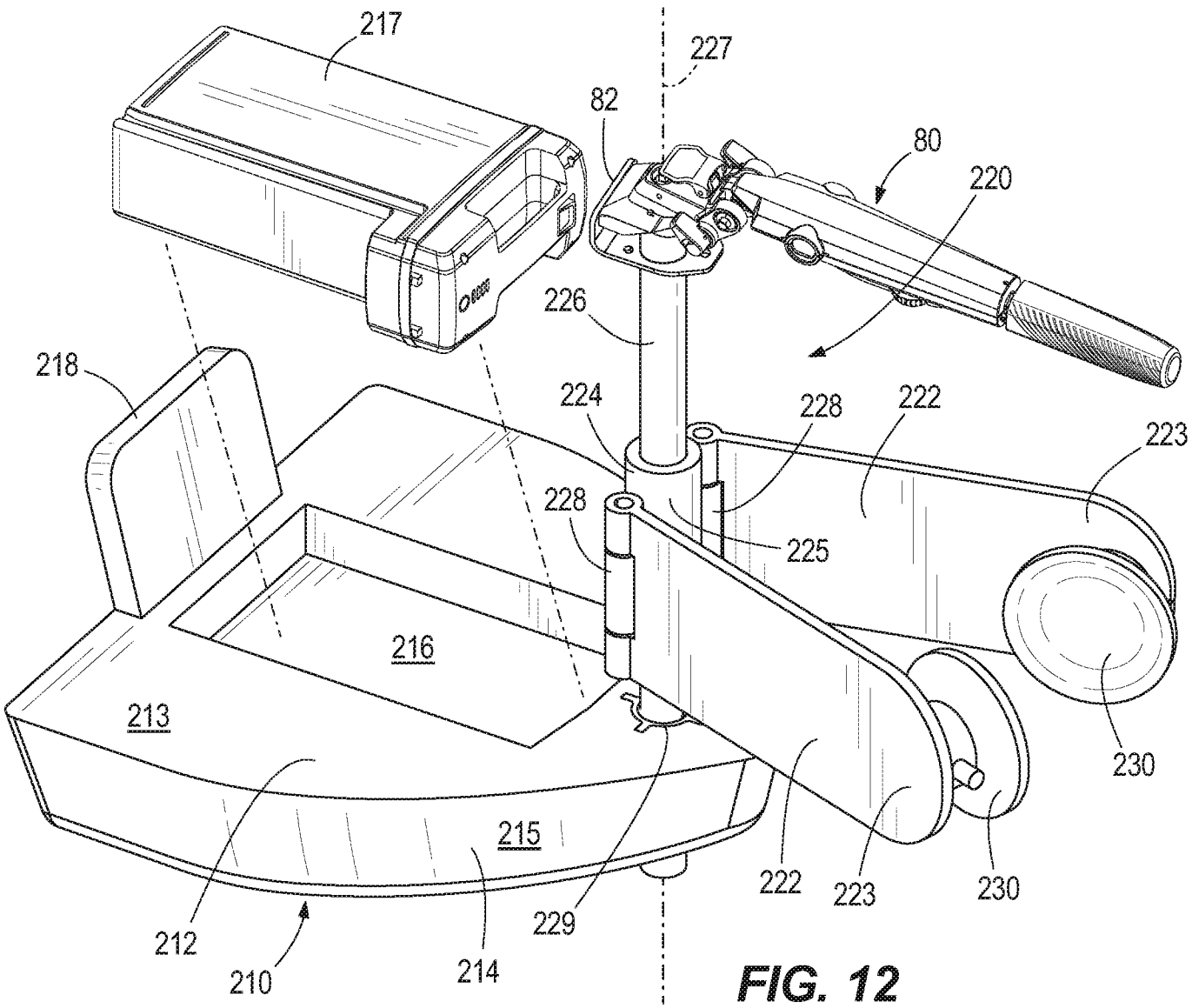
FIG. 12 is a perspective view of the accessory pod of FIG. 11.

Referring to FIG. 12, the accessory pod 210 includes a pod body 212 with a hull 214 defining the bottom and sides of the pod body 212 and an upper surface 213 defining the top side of the pod body 212. The hull 214 and the upper surface 213 enclose an interior cavity (not shown) that may be filled with air and/or another buoyant material so that the accessory pod 210 is positively buoyant and can support the marine drive 20 proximate the surface of the water. The outer surface 215 of the hull 214 has a hydrodynamic profile configured to reduce a drag force on the accessory pod 210 as the marine vessel 10 travels through the water. A mounting member 218, which is configured as a generally planar member, projects upwards from the upper surface 213 proximate the back end of the pod body 212. The illustrated mounting member 218 is configured to be engaged by the drive mounting bracket 30 of a marine drive 20 such that the lower unit 22 of the marine drive 20 extends below the surface of the water behind the accessory pod body 212.

In some embodiments, the pod body 212 may include an interior compartment 216 configured to receive at least one of mechanical components, electrical components and/or other hardware for operating the accessory pod system 200. As illustrated in FIGS. 9-12, for example, the interior compartment 216 is configured to receive a battery 217 that may be used to power a marine drive 20 (or any other marine accessory) supported on the accessory pod 210. This may be useful, for example, so that no rigging connectors extending between the marine drive 20 and the marine vessel 10 are required. Other embodiments may be configured to hold other components in the interior compartment 216, such as weight(s) configured as ballast, maintenance equipment, or any other objects or supplies. In the illustrated embodiment, the interior compartment 216 is formed in the upper surface 213 of the pod body 212 and is open to the exterior of the pod body 212. Some embodiments, however, may be configured with a lid and/or other closure configured to seal the interior compartment 216.

As with the accessory pod system 100 of FIGS. 1-8, the accessory pod system 200 of FIGS. 9-12 include a pod mounting bracket 220 configured to support the accessory pod system 200 at various locations on the hull 12 of the marine vessel 10. Referring to FIGS. 9-12, the pod mounting bracket 220 includes a pivot bracket 224 that defines the steering axis 227 and mounting arms 222 which extend from the pivot bracket 224 and suspend the pivot bracket 224 from the hull 12. The pivot bracket 224 includes a swivel cylinder 225 and a steering tube 226 that is pivotably received in the swivel cylinder 225 such that the swivel cylinder 225 and the steering tube 226 define the steering axis 227. The steering tube 226 is slidably received in the swivel cylinder 225 such that the accessory pod 210 may move up and down relative to the hull 12 of the marine vessel 10, for example, to accommodate heaving movement of the marine vessel 10 in the water. The steering tube 226 is received in a through bore 229 formed in the pod body 212 proximate a front end thereof and projects upwardly from the upper surface 213 to a top end of the steering tube 226. A tiller mounting bracket 82 is positioned at the top end of the steering tube 226, and the tiller arm 80 is coupled to the steering tube 226 via the tiller mounting bracket 82.

Figure 9:
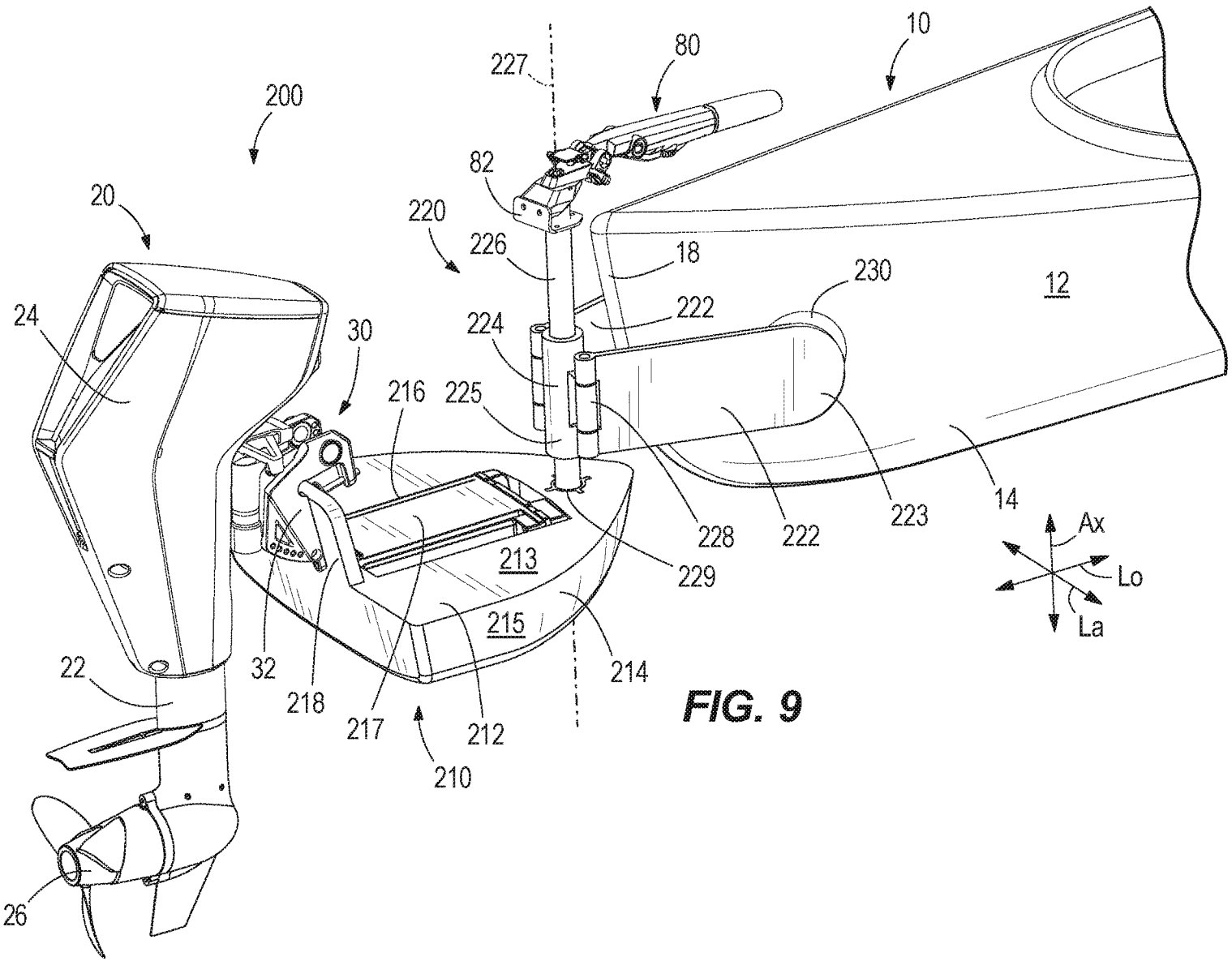
FIG. 9 is a perspective view of another embodiment of an accessory pod mounted on the rear of a marine vessel.
Figure 10:
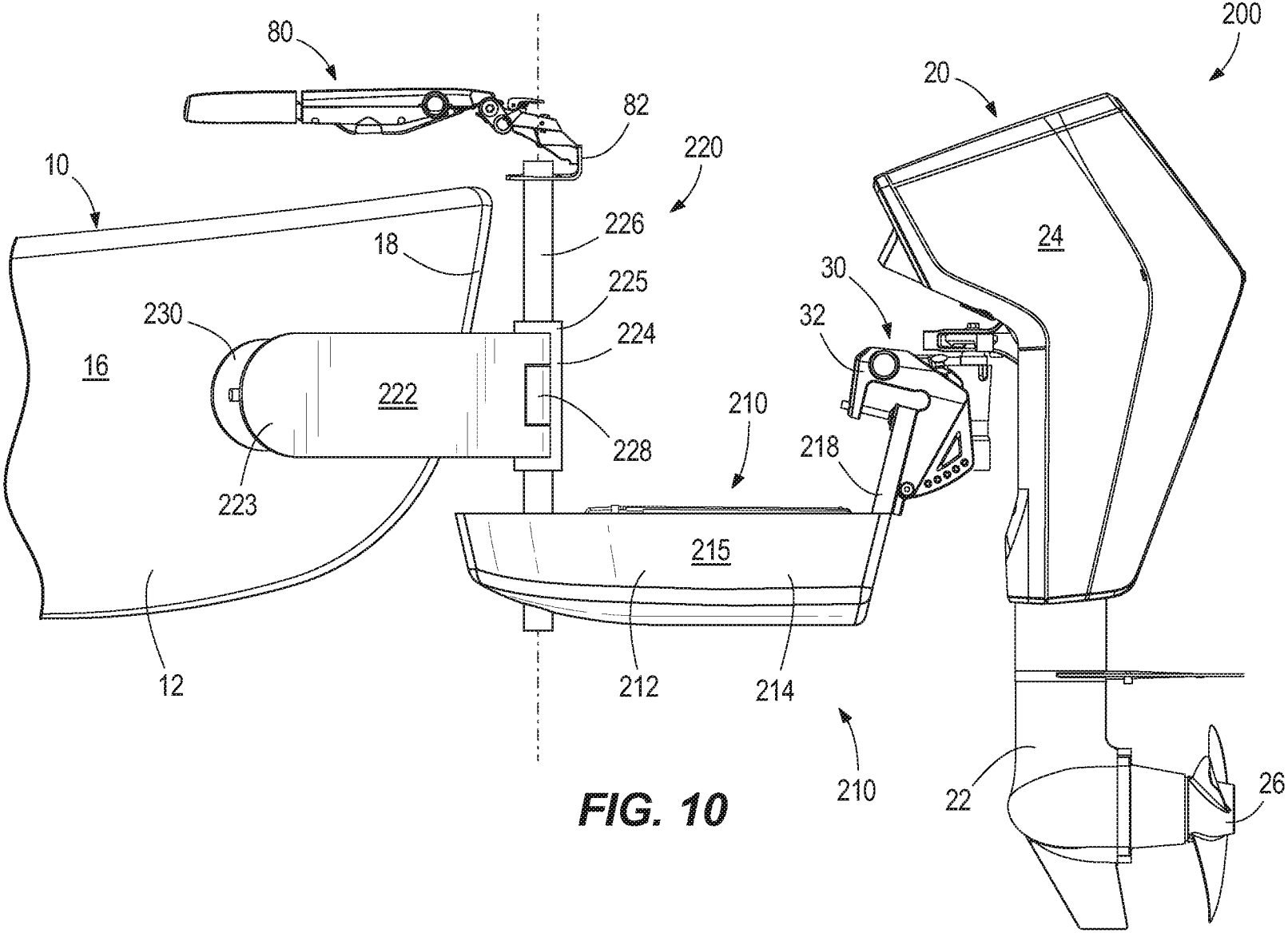
FIG. 10 is a side view of the marine vessel and the accessory pod of FIG. 9.
Figure 11:
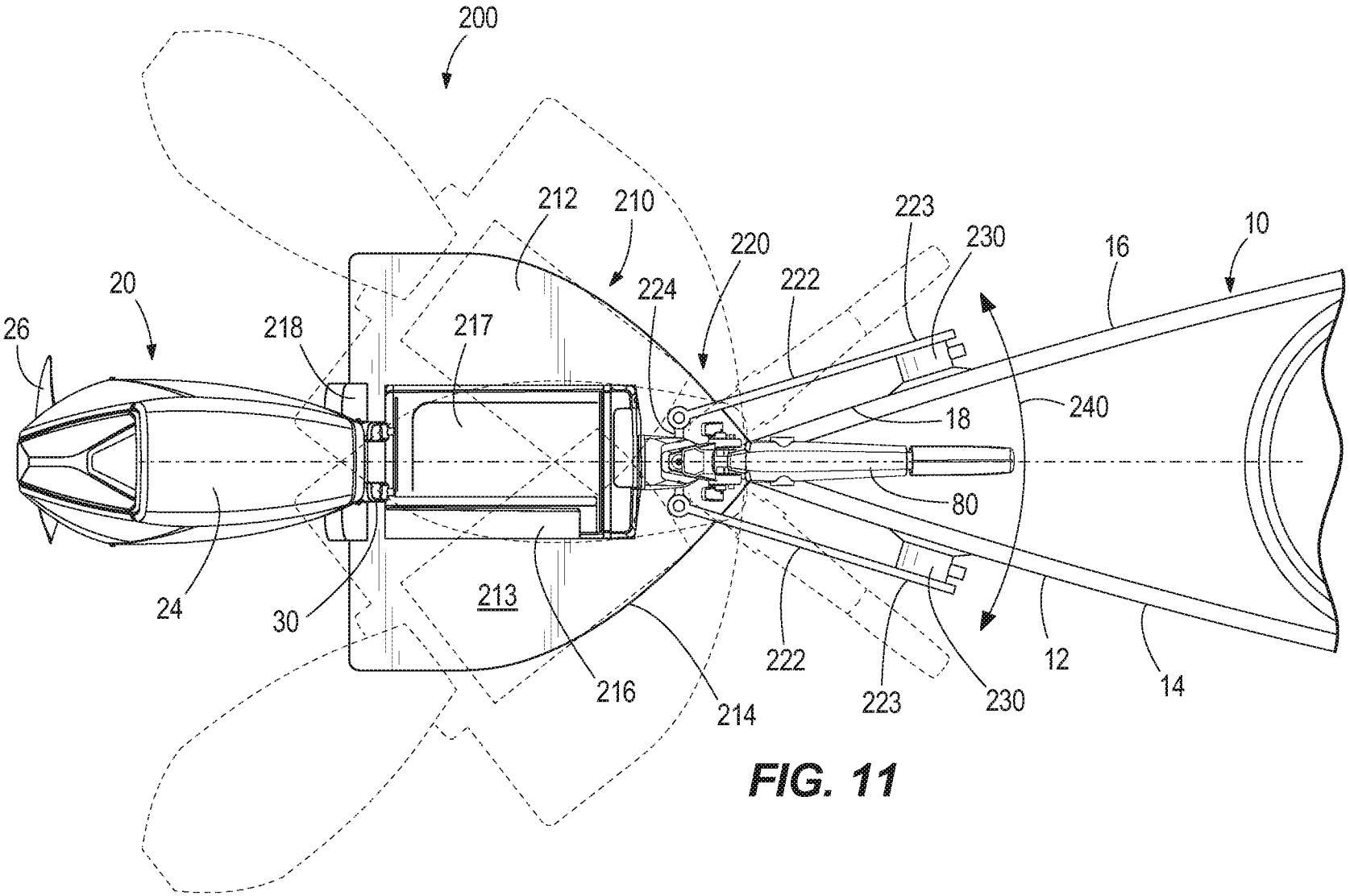
FIG. 11 is a top view of the marine vessel and the accessory pod of FIG. 10.

With continued reference to FIGS. 9 and 12, mounting arms 222 are pivotably coupled to mounting bosses 228 on opposite sides of the swivel cylinder 225. Each mounting arm 222 extends from the corresponding mounting boss 228 to a distal end 223 thereof, which includes a suction cup 230 (or other mounting hardware) for coupling the mounting arm 222 to the hull 12 of the marine vessel 10. As with the pod mounting bracket of FIGS. 1-9, the mounting arms 222 of FIGS. 9-12 are pivotable relative to each other and the swivel cylinder 225 so that the mounting arms 222 may be moved to conform to the exterior of the hull 12. Thus, the accessory pod system 200 may be coupled to various different locations on the marine vessel 10. In FIGS. 9-11, for example, the accessory pod system 200 is mounted on the stern 18 of the marine vessel 10 by clamping the mounting arms 222 onto the port and starboard sides 16, 14 of the hull 12. Additionally or alternatively, the accessory pod system 200 may be coupled to the port or starboard side 16, 14 of the marine vessel 10 similarly to the accessory pod system 100 of FIGS. 5-7, or to any other location on the hull 12. Once the accessory pod system 200 is installed on the marine vessel 10, a user may operate the marine drive 20 to propel the marine vessel 10 through the water, for example utilizing the tiller arm 80. Using the tiller arm 80, a user may pivot the accessory pod 210 towards the port side 16 or the starboard side 14 of the hull 12, for example in a direction of arrow 240 in FIG. 11, in order to steer the marine vessel 10 in the corresponding starboard or port direction.

This written description uses examples to disclose the invention and also to enable any person skilled in the art to make and use the invention. Certain terms have been used for brevity, clarity, and understanding. No unnecessary limitations are to be inferred therefrom beyond the requirement of the prior art because such terms are used for descriptive purposes only and are intended to be broadly construed. The patentable scope of the invention is defined by the claims and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

What is claimed is:

1. An accessory pod for securing a marine accessory to a hull of a marine vessel, the accessory pod comprising:

a pod body configured to be coupled to the hull of the marine vessel; and a mounting member on the pod body, the mounting member being configured to support the marine accessory on the pod body;

wherein the pod body is positively buoyant in water and configured to support the marine accessory in the water relative to the marine vessel, and wherein the accessory pod is steerable relative to the marine vessel about a steering axis.

2. The accessory pod according to claim 1, wherein the accessory pod is supported on the marine vessel by a steering tube that defines the steering axis.

3. The accessory pod according to claim 1, wherein the pod body comprises a pod hull defining an interior compartment within the pod body.

4. The accessory pod according to claim 3, wherein the pod hull has a hydrodynamic profile configured to reduce a drag force on the accessory pod as the marine vessel travels through the water.

5. An accessory pod for securing a marine accessory to a hull of a marine vessel, the accessory pod comprising:

a pod body configured to be coupled to the hull of the marine vessel; and a mounting member on the pod body, the mounting member being configured to support the marine accessory on the pod body;

wherein the pod body is positively buoyant in water and configured to support the marine accessory in the water relative to the marine vessel, and wherein the pod body comprises a support platform on which the mounting member is located; and at least one pontoon configured to support the support platform proximate a surface of the water.

6. The accessory pod according to claim 5, wherein the support platform comprises an opening through a body of the support platform, and wherein the marine accessory is configured to extend through the opening and into the water.

7. The accessory pod according to claim 1, wherein the marine accessory comprises a marine drive configured to propel the marine vessel through the water.

8. An accessory pod assembly configured to support a marine accessory on a hull of a marine vessel, the accessory pod assembly comprising:

an accessory pod comprising a pod body and a mounting member configured to support the marine accessory on the pod body; and a pod mounting bracket configured to support the accessory pod on the hull of the marine vessel;

wherein the pod body is positively buoyant in water and configured to support the marine accessory in the water relative to the marine vessel, and wherein the accessory pod is steerable relative to the pod mounting bracket about a steering axis.

9. The accessory pod assembly according to claim 8, wherein a first one of the accessory pod and the pod mounting bracket comprises a swivel cylinder and a second one of the accessory pod and the pod mounting bracket comprises a steering tube pivotably received in the swivel cylinder, wherein the swivel cylinder and the steering tube define the steering axis.

10. The accessory pod assembly according to claim 9, wherein the steering tube is configured to slide relative to the swivel cylinder along the steering axis to adjust a position of the accessory pod relative to the hull of the marine vessel.

11. The accessory pod assembly according to claim 8, wherein the pod mounting bracket comprises a pivot bracket defining the steering axis and a mounting arm extending from the pivot bracket to the hull of the marine vessel, wherein the pivot bracket is suspended from the hull of the marine vessel by the mounting arm.

12. The accessory pod assembly according to claim 11, wherein the mounting arm is a first mounting arm pivotable relative to the pivot bracket and the pod mounting bracket further comprises a second mounting arm pivotable relative to the pivot bracket, wherein the pivot bracket is suspended from the hull of the marine vessel by the first mounting arm and the second mounting arm.

13. The accessory pod assembly according to claim 12, wherein the first mounting arm and the second mounting arm are configured to clamp onto the hull of the marine vessel.

14. An accessory pod assembly configured to support a marine accessory on a hull of a marine vessel, the accessory pod assembly comprising:

an accessory pod comprising a pod body and a mounting member configured to support the marine accessory on the pod body; and a pod mounting bracket configured to support the accessory pod on the hull of the marine vessel;

wherein the pod body is positively buoyant in water and configured to support the marine accessory in the water relative to the marine vessel, and wherein the pod mounting bracket comprises at least one suction cup configured to secure the pod mounting bracket to an exterior surface of the hull of the marine vessel.

15. An accessory pod assembly configured to support a marine accessory on a hull of a marine vessel, the accessory pod assembly comprising:

an accessory pod comprising a pod body and a mounting member configured to support the marine accessory on the pod body; and a pod mounting bracket configured to support the accessory pod on the hull of the marine vessel;

wherein the pod body is positively buoyant in water and configured to support the marine accessory in the water relative to the marine vessel, and wherein the marine accessory comprises a marine drive configured to propel the marine vessel through a body of water, and wherein the marine drive is supported on the accessory pod by a drive mounting bracket that suspends the marine drive from a mounting member of the accessory pod.

16. A marine drive system configured to be suspended from a hull of a marine vessel, the marine drive system comprising:

an accessory pod comprising a pod body and a mounting member;

a pod mounting bracket configured to support the accessory pod on the hull of the marine vessel; and a marine drive configured to propel the marine vessel through a body of water, the marine drive being supported on the accessory pod by the mounting member;

wherein the pod body is positively buoyant in water and configured to support the marine drive in the water relative to the marine vessel and the accessory pod is pivotable relative to the pod mounting bracket about a steering axis to steer the marine drive relative to the marine vessel.

17. The marine drive system according to claim 16, wherein the pod mounting bracket comprises:

a pivot bracket defining the steering axis and supporting the accessory pod on the marine vessel; and a first mounting arm and a second mounting arm extending from the pivot bracket to the hull of the marine vessel;

wherein the pivot bracket is suspended from the hull of the marine vessel by the first mounting arm and the second mounting arm.

18. The marine drive system according to claim 17, further comprising a first suction cup on the first mounting arm and a second suction cup on the second mounting arm, wherein the first suction cup and the second suction cup suspend the pivot bracket from the hull of the marine vessel.

19. The accessory pod according to claim 7, wherein the mounting member is configured to be engaged by a drive mounting bracket to couple the marine drive to the accessory pod.

20. The accessory pod according to claim 5, wherein the marine accessory comprises a marine drive configured to propel the marine vessel through the water.

* * * * *